United States Patent [19]

Faulkner

[11] 4,351,400

[45] Sep. 28, 1982

[54] METHOD OF PREVENTING DRILL STRING OVERFLOW

[76] Inventor: Ben V. Faulkner, Rte. 1, Box 15, Washington, Okla. 73093

[21] Appl. No.: 202,797

[22] Filed: Oct. 31, 1980

[51] Int. Cl.[3] ..... E21B 21/14

[52] U.S. Cl. ..... 175/69

[58] Field of Search ..... 175/57, 69, 65, 212, 175/25, 70

[56] References Cited

U.S. PATENT DOCUMENTS

| | | | |
|---|---|---|---|
| 2,595,715 | 5/1952 | Sloan | 175/65 |
| 3,534,822 | 10/1970 | Campbell | 175/69 |
| 3,963,077 | 6/1976 | Faulkner | 175/25 |

*Primary Examiner*—Ernest R. Purser

*Attorney, Agent, or Firm*—Laney, Dougherty, Hessin & Beavers

[57] ABSTRACT

A method of preventing drilling fluid overflow when adding or removing drill pipe sections to or from a drill string disposed in a well bore comprising the steps of introducing gasified drilling fluid into the drill string until a predetermined volume thereof is introduced therein at a predetermined pressure thereby displacing non-gasified drilling fluid in the drill string downwardly and displacing drilling fluid from the annulus, releasing the pressurized gasified drilling fluid from the drill string whereby the gasified drilling fluid flows upwardly through the drill string and drilling fluid and gas are removed therefrom whereby the resulting equalized level of drilling fluid in the drill string is below the level at which the drill pipe sections are added to or removed from the drill string and then adding or removing drill pipe sections to or from the drill string.

5 Claims, 2 Drawing Figures

METHOD OF PREVENTING DRILL STRING OVERFLOW

BACKGROUND OF THE INVENTION

1. Field of the Invention

The present invention relates to a method of preventing drill string overflow, and more particularly, but not by way of limitation, to an improved method of lowering the level of drilling fluid in a drill string below the point at which drill pipe sections are added to or removed from the drill string.

2. Description of the Prior Art

In the drilling of well bores penetrating subterranean formations, it is frequently necessary to withdraw the drill string from the well bore to change the drill bit, replace worn out drill pipe sections, etc. In addition, during drilling it is necessary to add drill pipe sections to the drill string as the well bore is deepened.

During drilling, drilling fluid is circulated down the drill string, through ports or nozzles in the drill bit attached to the lower end thereof and up the annulus between the drill string and the walls of the well bore to the surface. When drilling is stopped for the addition or removal of pipe sections to or from the drill string, because the drilling fluid in the annulus contains cuttings from the formation being drilled, it has a higher density than the drilling fluid within the drill string. This difference in drilling fluid density causes the level of the drilling fluid in the drill string to be higher than the level of drilling fluid in the annulus, often higher than the level at which drill pipe sections are connected to or disconnected from the drill string, i.e., the level of the drilling rig floor. In addition, the nozzles in the drill bit at the bottom of the drill string restrict the drainage of the drill string as it is raised. The combination of the above factors results in the level of drilling fluid in the drill string and drilling rig conduits attached thereto usually always being above the rig floor which in turn causes drilling fluid to overflow at the point of drill string disconnection. The overflow of drilling fluid results in the loss thereof, and more importantly, hinders and causes unsafe conditions for personnel.

Methods have heretofore been developed and used for expediting the draining and equalization of drilling fluids to thereby prevent drilling fluid overflow when adding or removing drill pipe sections to and from drill strings. U.S. Pat. No. 2,595,715 issued May 6, 1952 to Sloan discloses a method for clearing the kelly of drilling mud each time it is hoisted for the addition of a new drill pipe section. In accordance with such method, compressed air or other gaseous fluid at superatmospheric pressure is introduced into the kelly to force the drilling fluid downwardly through the drill bit followed by the releasing of the air pressure. While this method has achieved success, it is time-consuming in that a large quantity of air or gas must be introduced into the drill string in order to lower the level of drilling fluid in the drill string whereby drilling fluid overflow does not occur. Consequently, the method has not received wide acceptance and drilling rig operators have generally heretofore accepted drilling fluid spillage as a necessary part of the operation of adding or removing drill pipe sections to or from drill strings.

An improved method of preventing drilling fluid overflow and formation fluid blowouts is described in my U.S. Pat. No. 3,963,077 issued June 15, 1976. In such method, a gas is introduced into the annulus between the well bore and the drill string until a predetermined gas pressure is reached therewithin whereby drilling fluid is displaced downwardly within the annulus and upwardly within the drill string. The gas pressure is then released from the annulus and the fluid levels in the drill string and annulus are allowed to equalize whereby the level of drilling fluid in the drill string is below the level at which drill pipe sections are disconnected therefrom or connected thereto. This method has also not received wide acceptance in that large quantities of gas are required for displacing the drilling fluid and the equalization of the drilling fluid levels in the drill string and annulus still require the drilling fluid to flow through the restricted nozzles in the drill bit making the method time-consuming.

By the present invention an improved method of preventing drilling fluid overflow when adding or removing drill pipe sections to or from a drill string disposed in a well bore is provided which is simple to carry out, which does not require large quantities of gas and which, consequently, is less time-consuming to carry out.

SUMMARY OF THE INVENTION

A method of preventing drilling fluid overflow when adding or removing drill pipe sections to or from a drill string comprising the steps of introducing gasified drilling fluid into the drill string until a predetermined volume thereof is introduced therein at a predetermined pressure thereby displacing drilling fluid downwardly within the drill string and upwardly within the annulus between the drill string and the well bore to lower the level of non-gasified drilling fluid in the drill string, releasing the pressurized gasified drilling fluid from the drill string whereby the gasified drilling fluid flows upwardly through the drill string and drilling fluid and gas are removed therefrom and the resulting level of drilling fluid in the drill string is below the level at which the drill pipe sections are added to or removed from the drill string and then adding or removing drill pipe sections to or from the drill string.

It is, therefore, a general object of the present invention to provide an improved method of preventing drill string overflow.

A further object of the present invention is the provision of a method of preventing drilling fluid overflow when adding or removing drill pipe sections to or from a drill string disposed in a well bore which is simple and requires little time to carry out.

Yet a further object of the present invention is the provision of a method of preventing drilling fluid overflow when adding or removing drill pipe sections to or from a drill string wherein the apparatus for carrying out the method can also be used for preventing freezing of aqueous drilling fluid in surface drilling rig apparatus during drilling fluid circulation shut-downs in cold environments.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

Figures 1, 2:
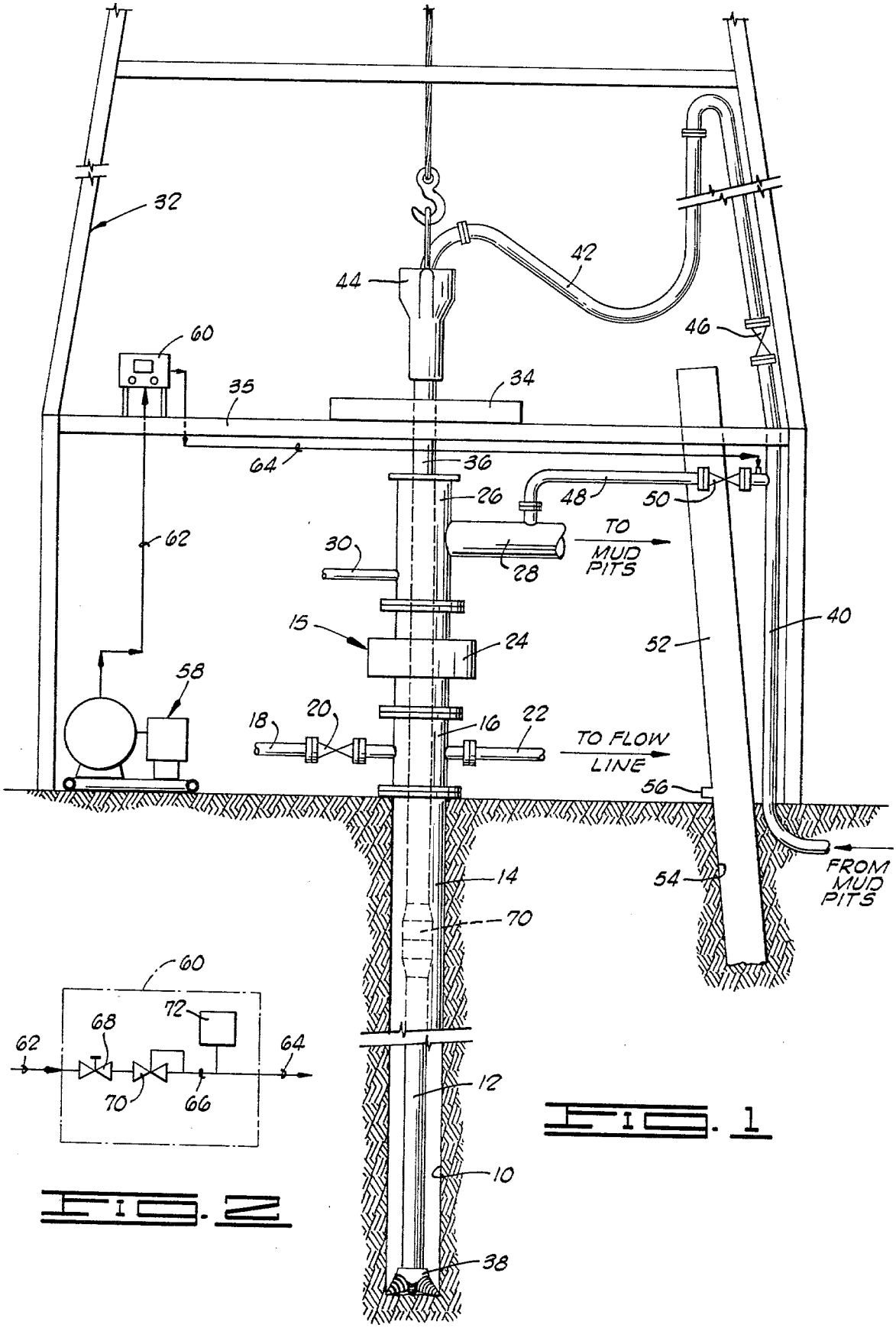
FIG. 1 is a diagrammatic illustration of a well bore having a conventional rotary drilling rig apparatus positioned thereover which includes apparatus for carrying out the method of the present invention.
FIG. 2 is a schematic illustration of one form of controlling and recording apparatus which can be utilized for carrying out the method of the present invention.

Referring now to the drawings and particularly to FIG. 1, a well bore 10 is illustrated having a conventional drill string 12 made up of drill pipe sections disposed therein. The well bore 10 is equipped with the usual arrangement of well head apparatus 15 including surface casing 14 disposed in the well bore 10 connected to a drilling spool 16 at the ground surface. A conduit 18 is connected to the drilling spool 16 having a shut-off valve 20 disposed therein and a conduit 22 is connected to the drilling spool 16 and to a flow line having a choke or other flow regulating valve disposed therein. The conduit 22 and flow regulating valve connected thereto are utilized to relieve formation fluid pressures from the well bore 10 in the event of a blowout, and the conduit 18 is utilized to introduce weighted drilling fluid into the well bore 10 to increase the hydrostatic head exerted on the well bore. One or more conventional blowout preventer apparatus 24 are connected to the drilling spool 16, and a conventional bell nipple 26 is connected above the blowout preventers 24 to complete the well head assembly. A large diameter conduit 28 is connected to the nipple 26 for conducting circulated drilling fluid from the annulus between the drill string 12 and walls of the well bore 10 to mud pits (not shown). A second conduit 30 is connected to the nipple 26 for introducing drilling fluid into the annulus when refilling the annulus.

A conventional rotary drilling rig, generally designated by the numeral 32, is positioned above the well bore 10. The rig 32 includes a rotary table 34 on the rig floor 35 for engaging and rotating a kelly 36. The kelly 36 is in turn attached to the upper end of the drill string 12. A drill bit 38 is connected to the bottom end of the drill string 12, and as the drill string 12 is rotated, thereby rotating the drill bit against the bottom of the well bore 10, drilling fluid is circulated downwardly through the kelly 36 and the drill string 12, through nozzles in the drill bit 38, upwardly through the annulus between the drill string 12 and the walls of the well bore 10 and through the conduit 28 to the mud pits. Cuttings produced by the drill bit 38 are removed from the drilling fluid and conditioned drilling fluid (cuttings removed, etc.) is pumped by mud pumps (not shown) from the mud pits into and through the usual stand pipe 40 and through a flexible hose 42. The flexible hose 42 is connected to a swivel 44 which is in turn connected to the top end of the kelly 36.

A shut-off valve 46 is disposed in the stand pipe 40 which is normally open, and a conduit 48 is connected between the stand pipe 40 at a point below the shut-off valve 46 therein and the large diameter conduit 28. A shut-off valve 50 is disposed in the conduit 48 which is normally closed.

The usual receptacle 52 for receiving the kelly 36 when it is disconnected from the drill string 12 such as when drill pipe sections are added to or removed from the drill string 12 is provided. The receptacle 52 extends into a bore 54 in the ground, commonly referred to as a rat hole, and includes a drain 56 located at the ground surface.

A conventional air compressor and receiver assembly 58 for generating compressed air is connected to a control panel 60 by a conduit 62. The control panel 60 is on the floor 35 of the rig 32 and is connected by a conduit 64 to the conduit 48 between the shut-off valve 50 therein and the stand pipe 40. As illustrated in FIG. 2, the control panel 60 includes a header 66 to which the conduits 62 and 64 are connected. Disposed in the header 66 adjacent the end to which the conduit 62 is attached is a shut-off valve 68 and adjacent the shut-off valve 68 is a pressure regulator 70. A pressure recorder 72 is connected to the header 66 downstream of the regulator 70.

In accordance with the method of the present invention, when it is necessary or desirable to remove all or a part of the drill string 12 from the well bore 10, the circulation of drilling fluid through the drill string and well bore is stopped by shutting down the mud pumps. At this point the annulus is completely filled with drilling fluid as is the drill string 12 and the kelly 36, and as described above, when the kelly 36 and drill string 12 are raised whereby the connection 70 therebetween is positioned above the rig floor 35 for disconnection, the level of drilling fluid in the kelly 36 is above the connection 70. In order to prevent the overflow of drilling fluid when the kelly 36 is disconnected from the drill string 12 and/or when drill pipe sections are added to the drill string 12, the mud pumps are started whereby drilling fluid is pumped from the mud pits at a predetermined rate through the stand pipe 40, through the flexible hose 42 and through the swivel 44 into the kelly 36 and drill string 12.

At this point, the valve 50 in the conduit 48 remains closed and the valve 46 in the stand pipe 40 remains open. Simultaneously with the pumping of drilling fluid, compressed air is introduced into the drilling fluid flowing through the stand pipe 40 by way of the conduit 64 connected to the conduit 48. The compressed air is introduced into the drilling fluid at a predetermined rate whereby aerated drilling fluid is formed in the stand pipe 40 which is introduced into the kelly 36 and the drill string 12. The introduction of the aerated drilling fluid is continued until a predetermined volume at a predetermined pressure has been placed in the kelly 36 and drill string 12 whereby non-aerated drilling fluid therein is displaced downwardly in the drill string 12, through the nozzles in the drill bit 38, upwardly through the annulus between the drill string 12 and the well bore 10, through the well head assembly 15 and to the mud pits by way of the conduit 28 attached to the nipple 26. Once the predetermined volume of aerated drilling fluid at the predetermined pressure has been introduced thereby displacing a predetermined volume of drilling fluid from the annulus to the mud pits, the introduction of aerated drilling fluid into the kelly 36 and drill string 12 is stopped. The valve 50 in the conduit 48 is next opened whereby pressure is released from the drill string 12 and the kelly 36. Upon the pressure release, aerated drilling fluid flows upwardly through the drill string 12 and kelly 36, through the swivel 24, through the hose 42, through the stand pipe 40, through the conduit 48, through the conduit 28 and into the mud pits. Because of the sudden pressure release, air is separated from the aerated drilling fluid and at least a portion of the drilling fluid forming the aerated drilling fluid and all of the air is removed from the drill string 12 and kelly 36 whereby the resultant level of drilling fluid in the drill string 12 and kelly 36 is below the level of the rig floor 35. The particular rates of drilling fluid and air, the air pressure, and the time required for displacing the required volume of drilling fluid from the kelly 36 and drill string 12 with aerated drilling fluid are calculated using conventional engineering techniques known to those skilled in the art.

Once the level of drilling fluid in the kelly 36 and drill string 12 has been lowered, the kelly 36 and drill string 12 are raised in the usual manner until the connection 70 between the kelly 36 and the drill string 12 is above the rotary table 34. The drill string 12 is then clamped in place and the kelly 36 removed therefrom without drilling fluid overflow. The kelly 36 is placed in the receptacle 52 while drill pipe sections are added to or removed from the drill string 12 using conventional techniques.

As will be understood by those skilled in the art, when compressed air is introduced into the stand pipe 40 to form aerated drilling fluid, the valve 68 in the control panel 60 is opened whereby compressed air flows from the air compressor and receiver assembly 58 through the conduit 62, through the pressure regulator 70 in the header 66 and through the conduit 64. The pressure recorder connected to the header 66 in the control panel 60 records the pressure of the air as the aerated drilling fluid is introduced into the kelly 36 and drill string 12. The pressure at which the air is injected into the stand pipe 40 is controlled by the regulator 70. As will be further understood, compressed air is preferred for carrying out the methods of this invention because of its economy and ease of availability at drilling sites. However, any available pressurized inert gas can be utilized for carrying out the methods of this invention and forming gasified drilling fluid.

The use of gasified or aerated drilling fluid to displace non-gasified or non-aerated drilling fluid in the kelly and drill string and from the well bore is particularly advantageous as compared to utilizing air alone in that less gas or air is required for the displacement and because drilling fluid can be introduced into the kelly and drill string at a high rate, considerably less time is required for the displacement. Upon the release of the pressurized gasified or aerated drilling fluid from the drill string and kelly, the gas or air as well as a major portion of the drilling fluid therein is removed and the drilling fluid is recovered in the mud pits for reuse.

When an aqueous drilling fluid is utilized which is usually the case and when environmental conditions are such that the aqueous drilling fluid remaining in the hose 42 and stand pipe 40 will freeze when the kelly 36 is in the receptacle 52, the valve 50 in the conduit 48 is closed, the valve 46 in the stand pipe 40 is opened, and compressed air is introduced into the stand pipe 40 by way of the conduit 64 attached thereto. The compressed air displaces drilling fluid from the stand pipe 40 above the level of the conduit 48 and from the hose 42 into the receptacle 52 from where it drains onto the ground by way of the drain 56. In order to prevent drilling fluid in the stand pipe 40 below the level of the connection of the conduit 48 thereto from freezing, the valves 46 and 50 can be closed and compressed air introduced into the stand pipe 40 whereby the drilling fluid remaining is displaced to a drain or back to the mud pits. The compressed air can also be used for other purposes such as purging water lines, etc.

In order to facilitate a clear understanding of the method of the present invention, the following example is given:

EXAMPLE

A well bore is being drilled below 3000 feet with $4\frac{1}{2}$ inch 20 pound per foot conventional drill pipe, $9\frac{5}{8}$ inch surface casing set at 3000 feet, and the drilling fluid utilized is a conventional aqueous drilling fluid having a density of 10 pounds per gallon. The annulus between the $4\frac{1}{2}$ inch drill pipe and the $9\frac{5}{8}$ inch surface casing has a volume of 0.3071 cubic feet per linear foot. The capacity of the drill pipe is 0.723 cubic feet per linear foot. The metal displacement of the drill pipe is 26.1909 feet per cubic foot.

A one-to-one volume ratio of compressed air-to-drilling fluid is used to form aerated drilling fluid and a total volume of 50 cubic feet of aerated drilling fluid is injected for displacement. Upon completion of displacement the fluid level of non-aerated drilling fluid is approximately 692 feet below the point of air injection and 50 cubic feet of drilling fluid are displaced from the annulus to the mud pits. The final surface pressure after completion of displacement is 360 pounds per square inch less the hydrostatic pressure of 692 feet of aerated drilling fluid. This pressure plus the lifting capacity of the compressed air phase of the aerated drilling fluid effects the recovery of a major portion of the displacement fluid upon pressure release and while equilibrium of fluid levels between the annulus and inside the drill pipe is effected.

Upon releasing the surface pressure and after recovery of aerated drilling fluid the equilibrium level of the two columns is at 120 feet below surface.

Thus, the present invention is well adapted to carry out the objects and attain the ends and advantages mentioned as well as those inherent therein. While presently preferred embodiments of the invention have been described for purposes of this disclosure, numerous changes in the arrangement of parts and order of steps will suggest themselves to those skilled in the art, which changes are encompassed in the spirit of this invention.

What is claimed is:

1. A method of preventing drilling fluid overflow when adding or removing drill pipe sections to or from a drill string disposed in a well bore comprising the steps of:

introducing gasified drilling fluid into said drill string until a predetermined volume thereof is introduced therein at a predetermined pressure thereby displacing non-gasified drilling fluid downwardly within said drill string and upwardly within the annulus between said drill string and said well bore to lower the level of non-gasified drilling fluid in said drill string a distance such that upon releasing the pressurized gasified drilling fluid from said drill string and removing drilling fluid and gas therefrom, the resulting level of drilling fluid in said drill string is below the level at which said drill pipe sections are added to or removed from said drill string;

releasing said pressurized gasified drilling fluid from said drill string whereby said gasified drilling fluid flows upwardly through said drill string and drilling fluid and air are removed therefrom; and then adding or removing drill pipe sections to or from said drill string.

2. The method of claim 1 wherein said gasified drilling fluid is aerated drilling fluid.

3. A method of preventing drilling fluid overflow when adding or removing drill pipe sections to or from a drill string disposed in a well bore comprising the steps of:

introducing drilling fluid into said drill string;

simultaneously injecting pressurized air into said drilling fluid while it is being introduced into said drill string whereby aerated drilling fluid is introduced into said drill string;

continuing the introduction of aerated drilling fluid into said drill string until a predetermined volume thereof is introduced at a predetermined pressure thereby displacing non-aerated drilling fluid downwardly within said drill string and upwardly within the annulus between said drill string and said well bore to lower the level of non-aerated drilling fluid in said drill string a distance such that upon releasing the pressurized aerated drilling fluid from said drill string and removing drilling fluid and air therefrom, the resulting level of drilling fluid in said drill string is below the level at which said drill pipe sections are added to or removed from said drill string;

releasing said pressurized aerated drilling fluid from said drill string whereby said aerated drilling fluid flows upwardly through said drill string and drilling fluid and air are removed therefrom; and then adding or removing drill pipe sections to or from said drill string.

4. A method of preventing aqueous drilling fluid overflow when adding or removing drill pipe sections to or from a drill string disposed in a well bore, the upper end of the drill string being attached to a kelly which is in turn attached to a swivel and a drilling fluid conduit system for introducing drilling fluid into the kelly and drill string comprising the steps of:

introducing aerated drilling fluid into said kelly and drill string by way of said drilling fluid conduit system until a predetermined volume thereof is introduced therein at a predetermined pressure thereby displacing drilling fluid downwardly within said kelly and drill string and upwardly within the annulus between said drill string and said well bore to lower the level of non-aerated drilling fluid in said kelly and drill string a distance such that upon releasing the pressurized aerated drilling fluid from said kelly and drill string and removing drilling fluid and air therefrom, the resulting level of drilling fluid in said kelly and drill string is below the point of disconnection of said kelly from said drill string;

releasing said pressurized aerated drilling fluid from said kelly and drill string whereby said aerated drilling fluid flows upwardly through said kelly and drill string into said conduit system and drilling fluid and air are removed therefrom;

removing said kelly from said drill string; and adding or removing pipe sections to or from said drill string.

5. The method of claim 4 which is further characterized to include the step of purging said kelly and conduit system with air after said kelly is removed from said drill string to remove aqueous drilling fluid therefrom and prevent the freezing thereof.

* * * * *